US008051748B2

(12) United States Patent
Lin

(10) Patent No.: US 8,051,748 B2
(45) Date of Patent: Nov. 8, 2011

(54) SMALL BUT EFFECTIVE TOOLKIT

(76) Inventor: Jack Lin, Taichung (TW)

( * ) Notice: Subject to any disclaimer, the term of this patent is extended or adjusted under 35 U.S.C. 154(b) by 220 days.

(21) Appl. No.: 12/506,550

(22) Filed: Jul. 21, 2009

(65) Prior Publication Data

US 2011/0017027 A1 Jan. 27, 2011

(51) Int. Cl.
*B25B 23/16* (2006.01)
*B25G 1/00* (2006.01)

(52) U.S. Cl. ..... 81/177.1; 81/177.5

(58) Field of Classification Search ..... 81/177.1, 81/177.2, 177.5, 52, 438; D8/82, 83, 85
See application file for complete search history.

(56) References Cited

U.S. PATENT DOCUMENTS

| | | | | | |
|---|---|---|---|---|---|
| D298,101 | S | * | 10/1988 | Chen | D8/85 |
| 5,001,947 | A | * | 3/1991 | Andersen-Vie | 81/58.1 |
| 5,481,949 | A | * | 1/1996 | Yen | 81/438 |
| 5,555,781 | A | * | 9/1996 | Pool et al. | 81/436 |
| 5,669,273 | A | * | 9/1997 | Huang | 81/438 |
| 6,062,111 | A | * | 5/2000 | Wershe | 81/177.4 |
| 6,606,925 | B1 | * | 8/2003 | Gmeilbauer | 81/177.1 |
| 7,331,261 | B2 | * | 2/2008 | Blizniuk et al. | 81/124.4 |
| 2002/0092386 | A1 | * | 7/2002 | Lin | 81/177.1 |
| 2004/0163501 | A1 | * | 8/2004 | Chen | 81/177.1 |
| 2007/0251355 | A1 | * | 11/2007 | Kao | 81/177.4 |

* cited by examiner

*Primary Examiner* — David B Thomas

(57) ABSTRACT

A toolkit includes a handle and at least one bit set. The handle is in the form of a plate including a first cavity defined in a middle portion and a second cavity defined in a terminal portion. The bit set includes a bit and a cap non-rotationally provided on the bit. The cap is non-rotationally inserted through the first cavity where only a mild torque is needed. The cap is non-rotationally inserted through the second cavity where a large torque is needed.

5 Claims, 8 Drawing Sheets

SMALL BUT EFFECTIVE TOOLKIT

BACKGROUND OF INVENTION

1. Field of Invention

The present invention relates to a toolkit and, more particularly, to a small but effective toolkit.

2. Related Prior Art

A conventional screwdriver includes a handle and a bit. The bit includes a connecting tip fit in the handle and a working tip for engagement with a head of a screw. To drive various shapes and sizes of screws, many conventional screwdrivers are needed, and this is an expensive and inconvenient process.

As disclosed in Taiwanese Patent M3187904, a screwdriver 10 includes a handle 10 and a bit 20. The handle 10 includes a socket 12 formed on an S-shaped plate 13. The bit 20 includes a connecting tip 21 for non-rotationally insertion in the socket 12 and a working tip 22 for engagement with a head of a screw. The socket 12 is located in a middle portion of the S-shaped plate 13 so that only half of the length is useful in providing a torque. The length of the handle 10 is small for convenient operation and storage of the handle 10. Therefore, it is not easy to exert a large torque with the handle 10. To exert a large torque, it is desirable to make the handle 10 large; however this would render the operation and storage of the handle 10 inconvenient.

The present invention is therefore intended to obviate or at least alleviate the problems encountered in prior art.

SUMMARY OF INVENTION

It is the primary objective of the present invention to provide a small but effective toolkit.

To achieve the foregoing objective, the toolkit includes a handle and at least one bit set. The handle is in the form of a plate including a first cavity defined in a middle portion and a second cavity defined in a terminal portion. The bit set includes a bit and a cap provided on the bit non-rotationally. The cap is non-rotationally inserted through the first cavity in need of a mild torque. The cap is non-rotationally inserted through the second cavity in need of a large torque.

Other objectives, advantages and features of the present invention will be apparent from the following description referring to the drawings.

BRIEF DESCRIPTION OF DRAWINGS

The present invention will be described via detailed illustration of two embodiments referring to the drawings.

DETAILED DESCRIPTION OF EMBODIMENTS

Figure 1:
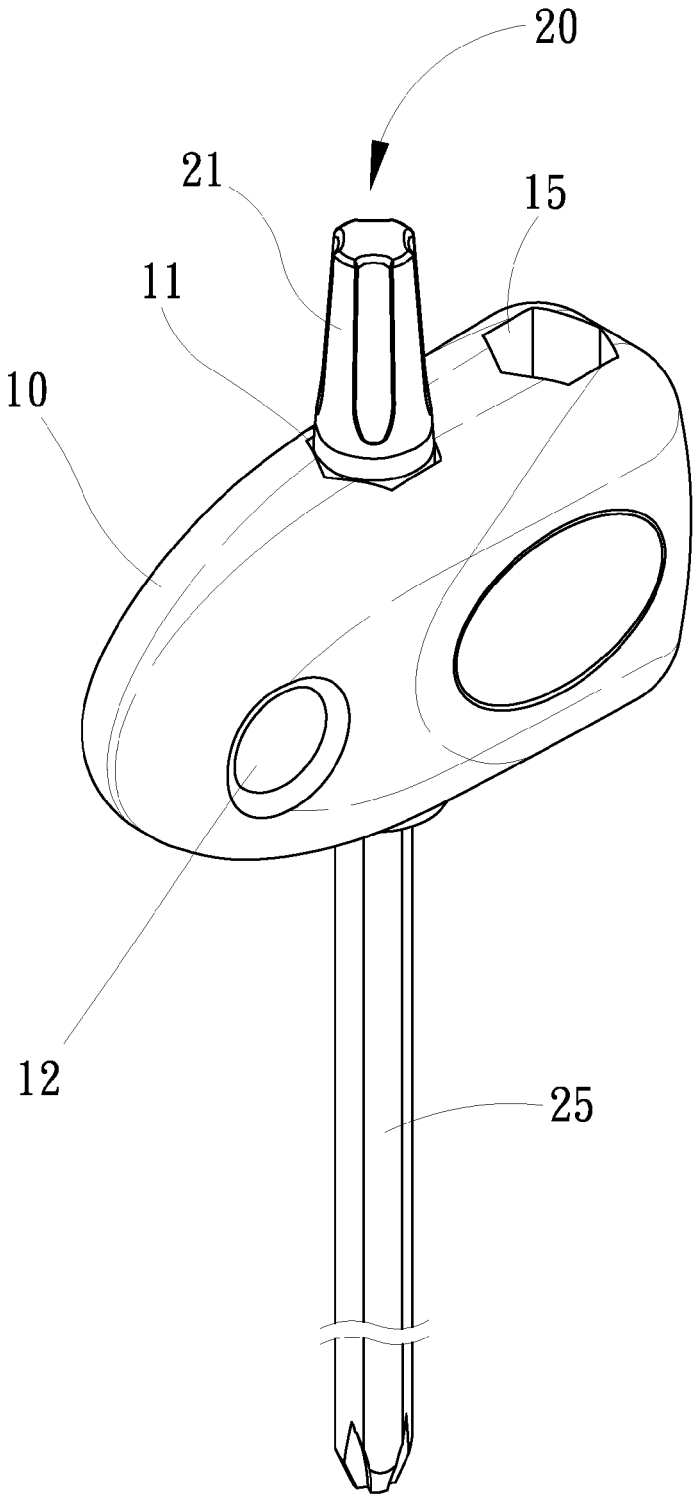
FIG. 1 is a perspective view of a toolkit according to the first embodiment of the present invention.
Figure 2:
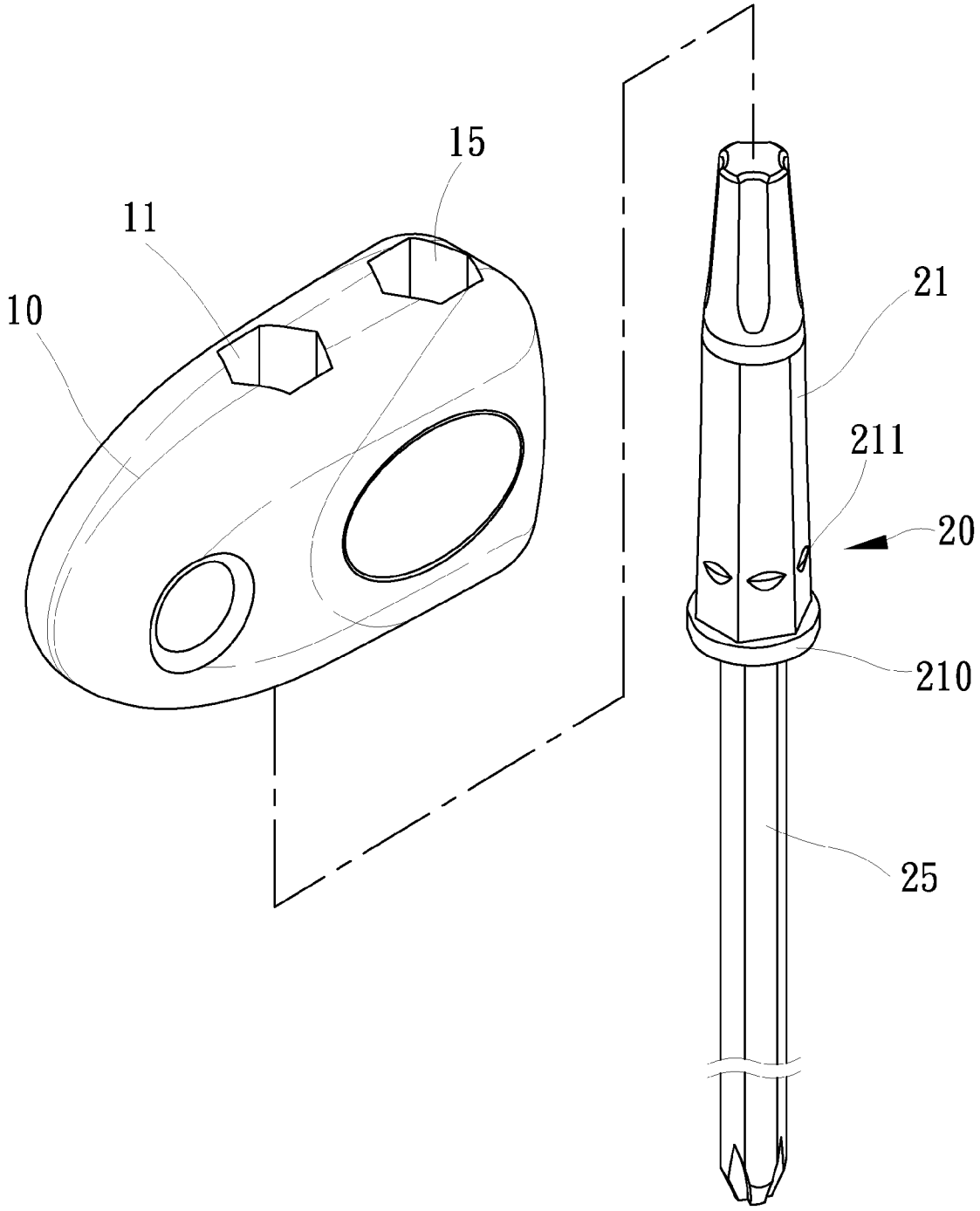
FIG. 2 is an exploded view of the toolkit shown in FIG. 1.

Referring to FIGS. 1 through 4, a toolkit includes a handle 10 and at least one bit set 20 according to a first embodiment of the present invention. The handle 10 is made of plastics and in the form of a plate including an aperture 12 defined therein, a first cavity 11 defined in a middle portion and a second cavity 15 defined in a terminal portion. With the aperture 12, the handle 10 can be hung on a nail or hook on a wall for example. The first cavity 11 is a countersink with a shoulder 110 and bosses 111 on the wall thereof. The second cavity 15 is a countersink with a shoulder 150 and bosses 151 on the wall thereof.

The bit set 20 includes a cap 21 and a bit 25 including a connecting tip non-rotationally fit in the cap 21 and a working tip for engagement with a head of a screw for example. The cap 21 is made of plastics. The cap 21 includes a flange 210 corresponding to the shoulder 110 or 150 and bosses 211 corresponding to the bosses 111 or 151. The bit 25 is made of metal.

Figure 3:
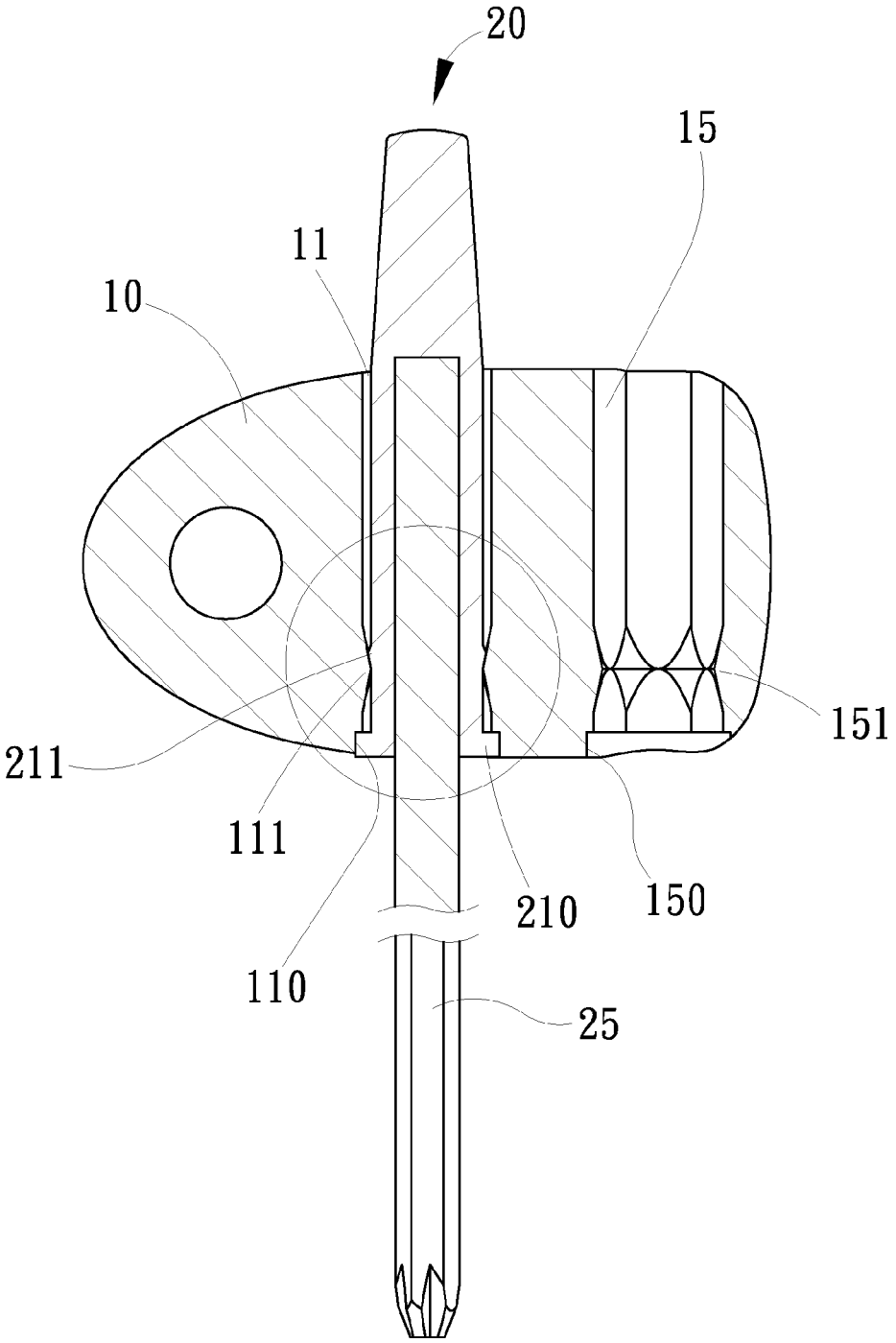
FIG. 3 is a cross-sectional view of the toolkit shown in FIG. 1.
Figure 5:
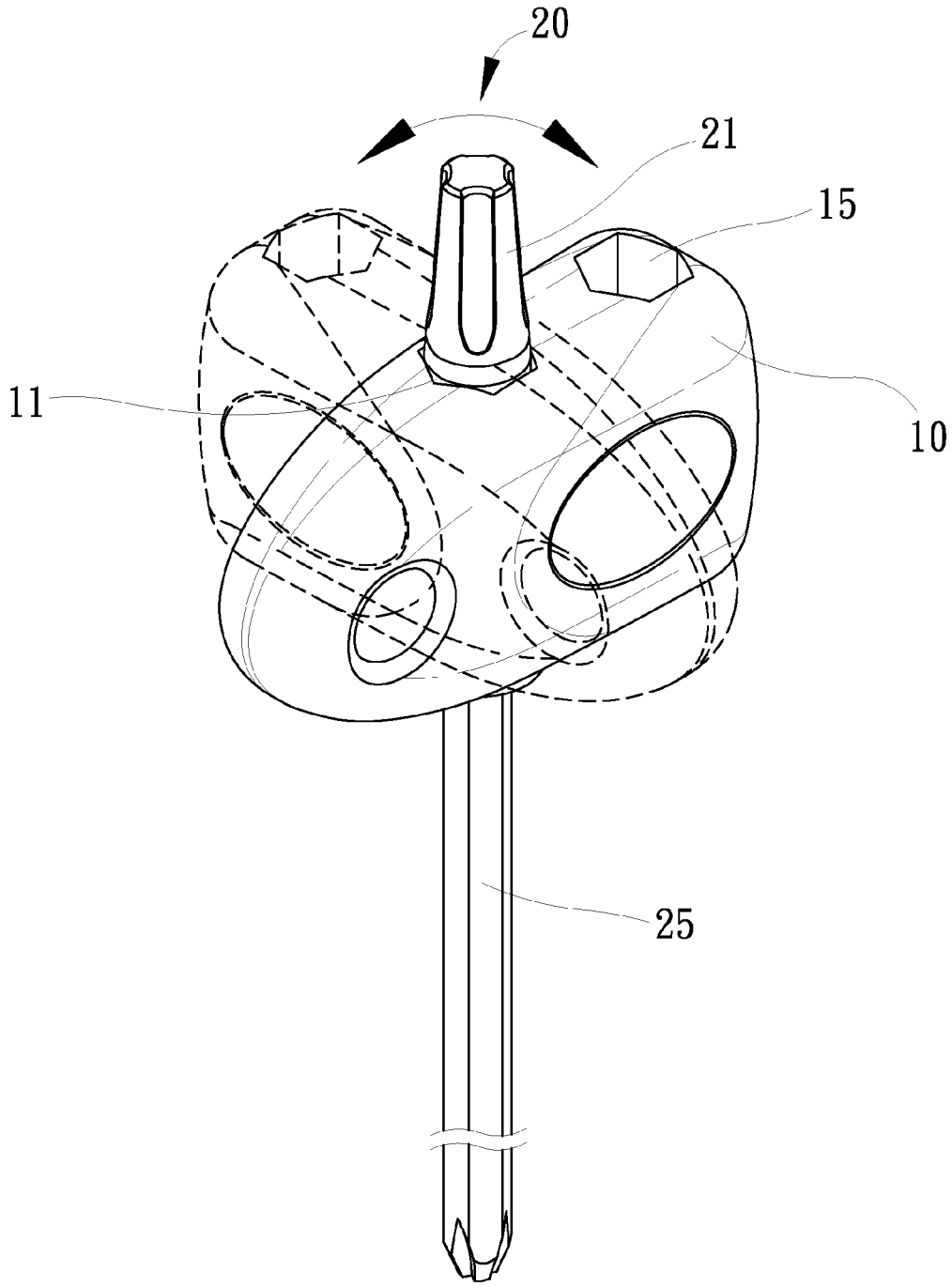
FIG. 5 is a perspective view of the toolkit shown in FIG. 3.

Referring to FIGS. 3 and 5, the cap 21 is inserted through the first countersink 11 where only a mild torque is needed. About half of the length of the handle 10 is useful in exerting a torque because the first countersink 11 is located in the middle portion of the handle 10. The flange 210 is abutted against the shoulder 110, thus preventing the cap 21 from being stuck in the first countersink 11. The bosses 211 are abutted against the bosses 111 to retain the cap 21 within the first countersink 11.

Figure 4:
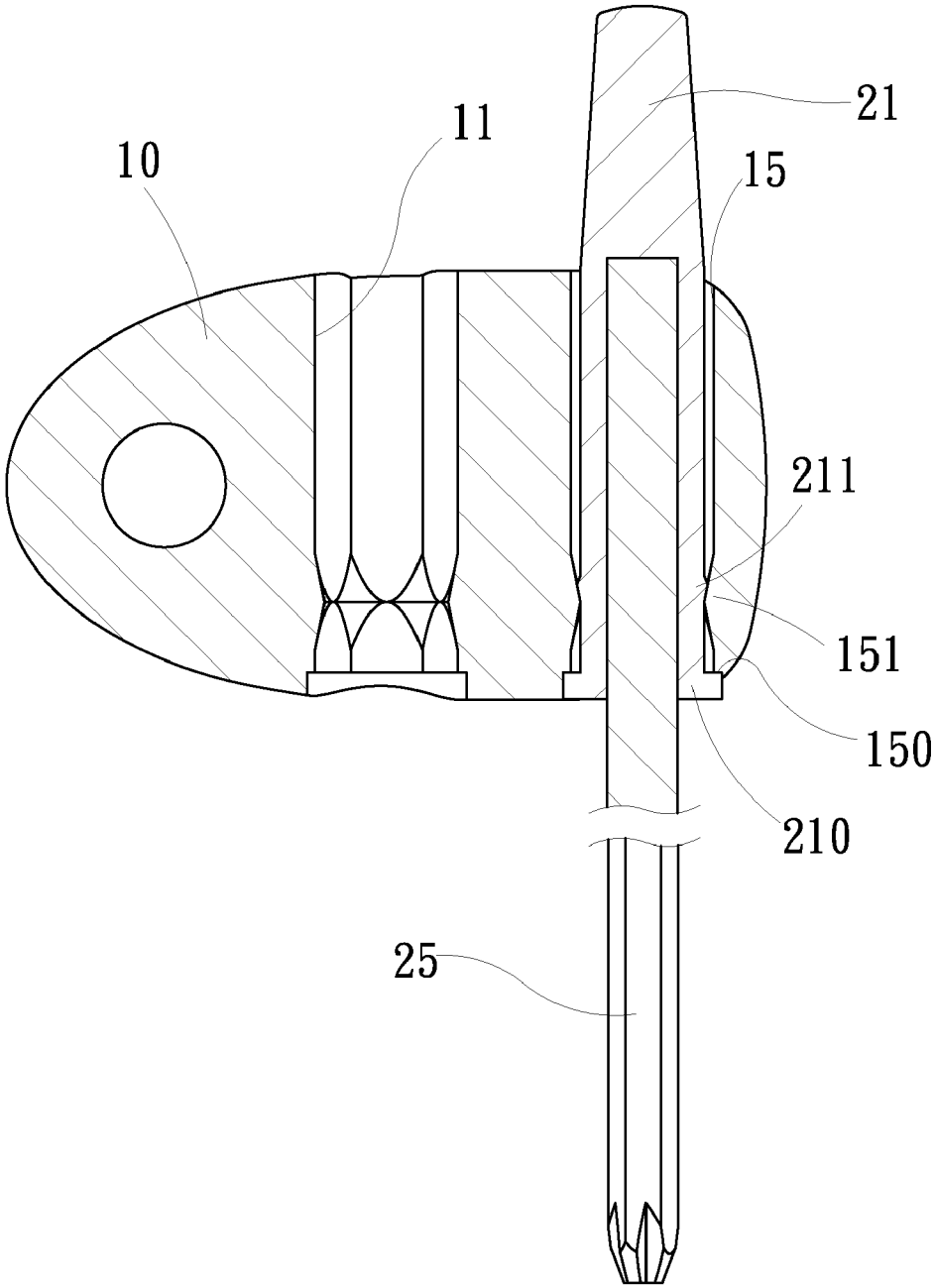
FIG. 4 is a cross-sectional view of the toolkit in another position than shown in FIG. 3.
Figure 6:
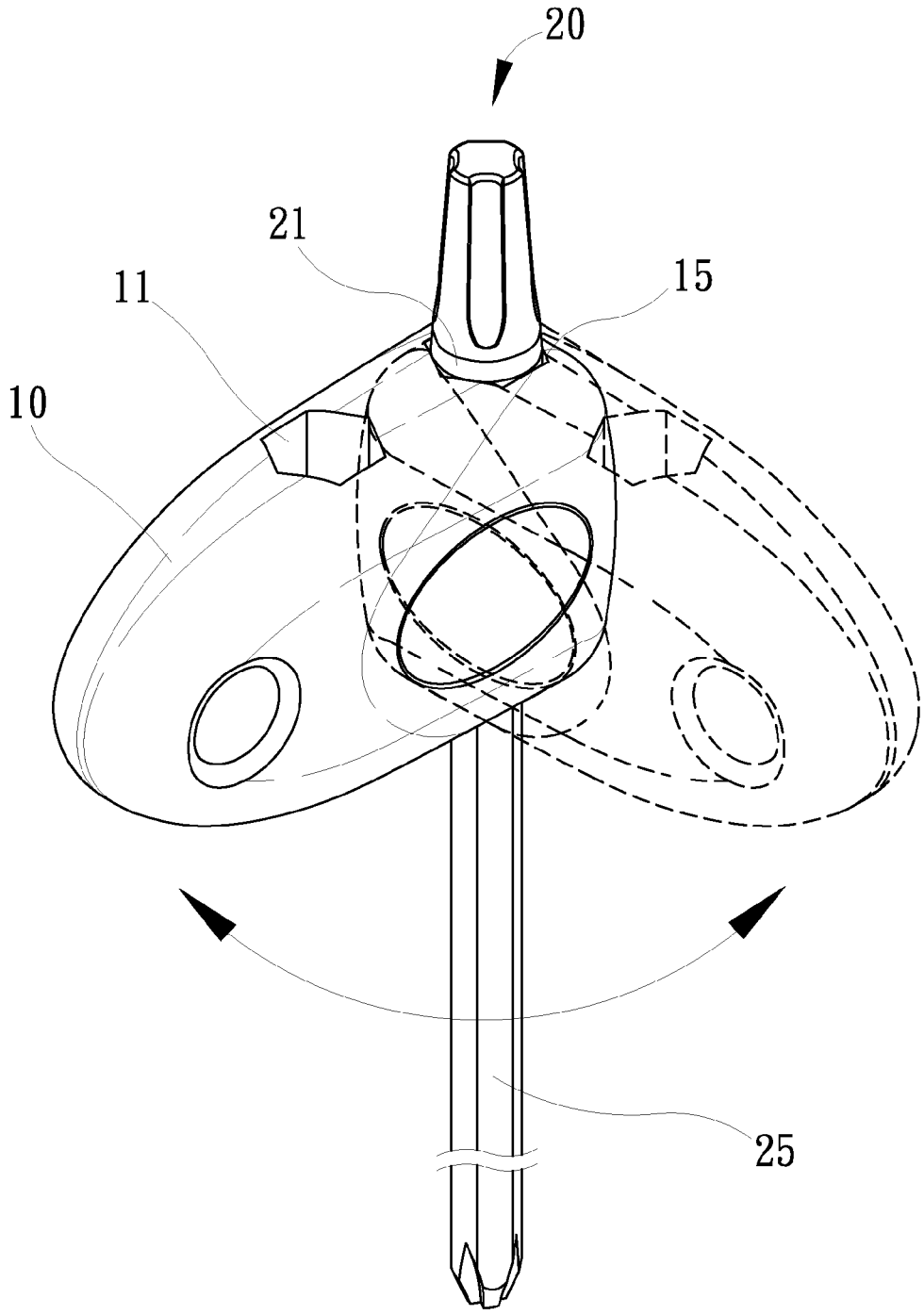
FIG. 6 is a perspective view of the toolkit shown in FIG. 4.

Referring to FIGS. 4 and 6, the cap 21 is inserted through the second countersink 15 where a large torque is needed. The entire length of the handle 10 is useful in exerting a torque because the second countersink 15 is located in the terminal portion of the handle 10. The flange 210 is abutted against the shoulder 150, thus preventing the cap 21 from being stuck in the second countersink 15. The bosses 211 are abutted against the bosses 151 to retain the cap 21 within the second countersink 15.

Figure 7:
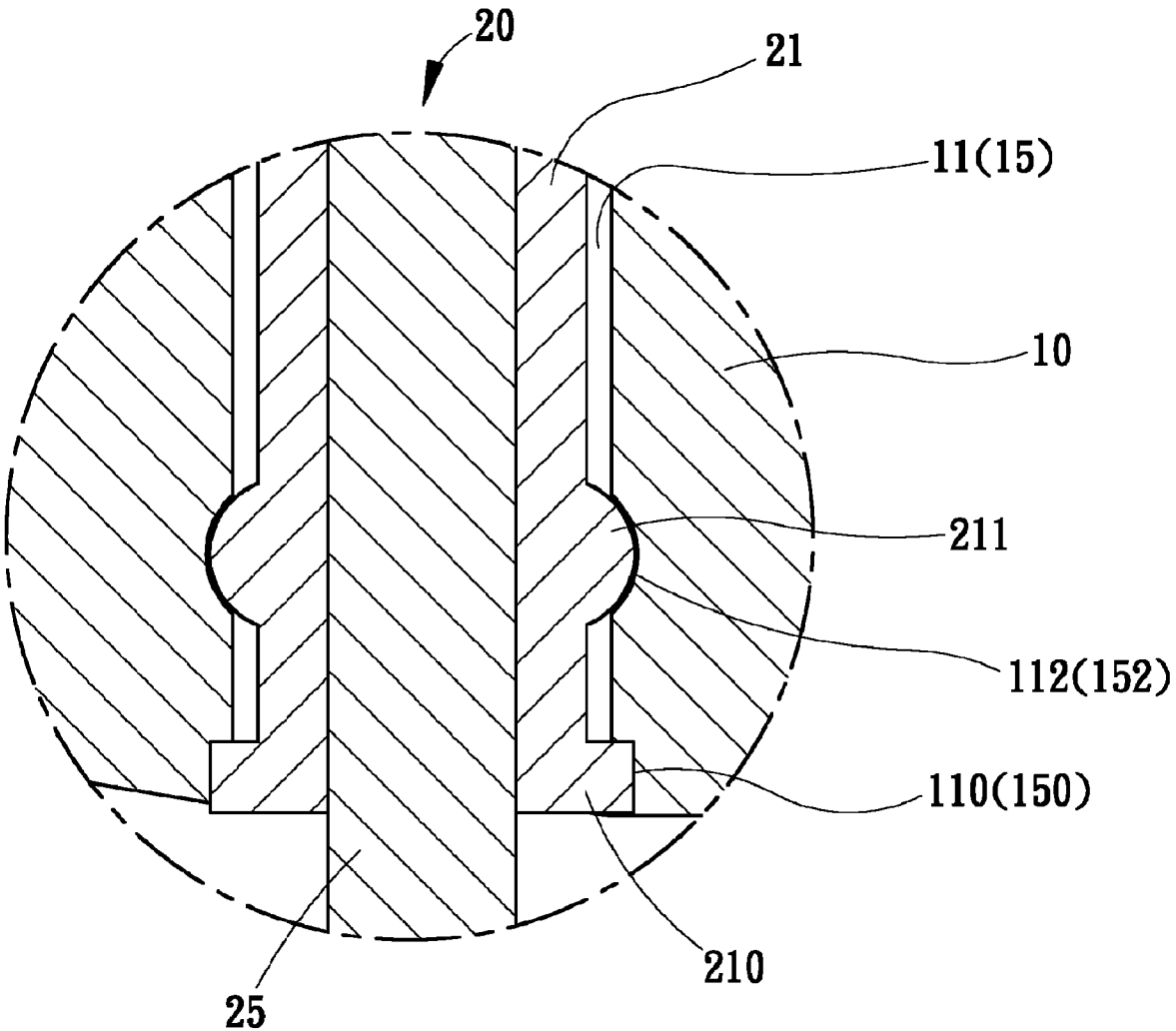
FIG. 7 is an enlarged cross-sectional view of a toolkit according to the second embodiment of the present invention.

Referring to FIG. 7, there is shown a toolkit according to a second embodiment of the present invention. The second embodiment is like the first embodiment except that the handle 10 includes recesses 112 instead of the bosses 111 and recesses 152 instead of the bosses 151. The bosses 211 can be disposed in the recesses 112 or 152 to retain the cap 21 within the countersink 11 or 15.

Figure 8:
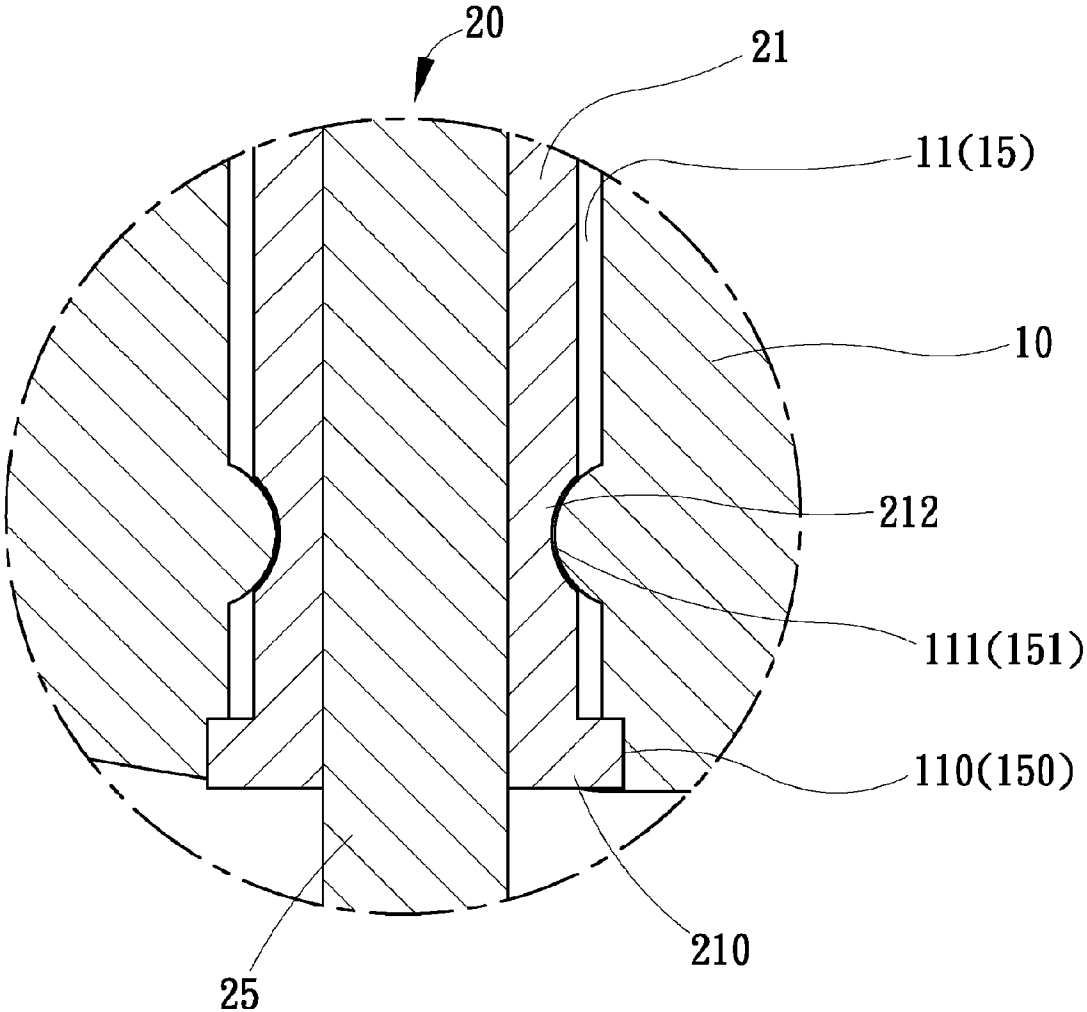
FIG. 8 is an enlarged cross-sectional view of a toolkit according to the third embodiment of the present invention.

Referring to FIG. 8, there is shown a toolkit according to a third embodiment of the present invention. The second embodiment is like the second embodiment except that the cap 21 includes recesses 212 instead of the bosses 211. The recesses 212 can receive the bosses 111 or 151 to retain the cap 21 within the countersink 11 or 15.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A toolkit comprising:

A handle in the form of a plate comprising a first cavity defined in a middle portion and a second cavity defined in a terminal portion; and at least one bit set comprising a bit and a cap non-rotationally provided on the bit, both of the first and second cavities being in the form of a countersink with a shoulder, and the cap comprising a flange for abutment against the shoulder, wherein the cap is non-rotationally inserted in the first cavity where only a mild torque is needed and in the second cavity where a large torque is needed.

2. The toolkit according to claim 1, wherein the handle comprises an aperture defined therein so that the handle can be hung on an external object.

3. The toolkit according to claim 1, wherein the handle comprises bosses formed on a wall of each of the first and second cavities, and the cap comprises bosses for abutment against the bosses of the handle.

4. The toolkit according to claim 1, wherein the handle comprises recesses defined in a wall of each of the first and second cavities, and the cap comprises bosses for insertion in the bosses of the handle.

5. The toolkit according to claim 1, wherein the handle comprises bosses formed on a wall of each of the first and second cavities, and the cap comprises recesses for receiving the bosses of the handle.

* * * * *